US011227471B2

(12) United States Patent
Adams et al.

(10) Patent No.: US 11,227,471 B2
(45) Date of Patent: Jan. 18, 2022

(54) WIRELESS SECURITY AND ASSISTANCE SYSTEM

(71) Applicant: SE-KURE CONTROLS, INC., Franklin Park, IL (US)

(72) Inventors: David M. Adams, Stone Park, IL (US); Lazaro Fraiman, Skokie, IL (US); Roger J. Leyden, Franklin Park, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 16/992,355

(22) Filed: Aug. 13, 2020

(65) Prior Publication Data

US 2020/0372774 A1 Nov. 26, 2020

Related U.S. Application Data

(63) Continuation-in-part of application No. 15/845,581, filed on Dec. 18, 2017, now abandoned, which is a continuation-in-part of application No. 15/426,509, filed on Feb. 7, 2017, now abandoned.

(60) Provisional application No. 62/294,610, filed on Feb. 12, 2016.

(51) Int. Cl.

| | |
|---|---|
| ***G08B 21/00*** | (2006.01) |
| ***G08B 13/24*** | (2006.01) |
| ***G08B 25/10*** | (2006.01) |

(52) U.S. Cl.

CPC ..... *G08B 13/2448* (2013.01); *G08B 25/10* (2013.01)

(58) Field of Classification Search

CPC . G08B 13/2448; G08B 25/10; G08B 13/1445
USPC ..... 340/539.12
See application file for complete search history.

(56) References Cited

U.S. PATENT DOCUMENTS

| | | | |
|---|---|---|---|
| 5,014,040 | A | 5/1991 | Weaver et al. |
| 5,398,276 | A | 3/1995 | Lemke et al. |
| 5,710,551 | A | 1/1998 | Ridgeway |
| 5,841,352 | A | 11/1998 | Prakash |
| 5,952,921 | A | 9/1999 | Donnelly |
| 6,081,717 | A | 6/2000 | Shah et al. |
| 6,104,295 | A | 8/2000 | Gaisser et al. |
| 6,154,139 | A | 11/2000 | Heller |
| 6,326,891 | B1 | 12/2001 | Lin |
| 6,529,131 | B2 | 3/2003 | Wentworth |
| 6,888,463 | B1 | 5/2005 | Mengrone et al. |

(Continued)

*Primary Examiner* — Mark S Rushing
(74) *Attorney, Agent, or Firm* — Wood, Phillips, Katz, Clark & Mortimer

(57) ABSTRACT

A wireless system for monitoring portable articles includes a central alarm unit (CAU) comprising a programmed controller operatively associated with a CAU wireless communication circuit. At least one wireless sensor comprises a programmed controller operatively associated with a sensor wireless communication circuit for communicating with the CAU wireless communication circuit. The CAU is programmed to periodically determine distance between the wireless sensor and the CAU and operates in a programming mode and responsive to manual input commands to determine a normal distance of the article being monitored from the CAU. The CAU is programmed to define a first zone as the normal distance plus a first select amount and a second zone as the normal distance plus a second select amount, greater than the first select amount.

28 Claims, 14 Drawing Sheets

(56) References Cited

U.S. PATENT DOCUMENTS

| | | | |
|---|---|---|---|
| 6,963,283 | B1 | 11/2005 | Gonzalez |
| 7,084,771 | B2 | 8/2006 | Gonzalez |
| 7,091,863 | B2 | 8/2006 | Ravet |
| 7,385,513 | B2 | 6/2008 | Everest et al. |
| 7,423,538 | B2 | 9/2008 | Gonzalez |
| 8,094,011 | B2 | 1/2012 | Faris et al. |
| 8,761,668 | B2 | 6/2014 | Park |
| 9,385,821 | B2 | 7/2016 | Jin et al. |
| 9,558,471 | B2 | 1/2017 | Reynolds et al. |
| 9,609,281 | B2 | 3/2017 | Mariadoss |
| 9,658,310 | B2 | 5/2017 | Loverich et al. |
| 9,666,047 | B2 | 5/2017 | Slavin et al. |
| 9,679,235 | B2 | 6/2017 | Sugar |
| 9,731,744 | B2 | 8/2017 | Carter et al. |
| 9,740,822 | B2 | 8/2017 | Jackson |
| 9,767,662 | B2 | 9/2017 | Lax et al. |
| 9,805,229 | B2 | 10/2017 | Berge et al. |
| 9,813,850 | B2 | 11/2017 | Lee et al. |
| 9,820,029 | B2 | 11/2017 | Poulsen |
| 9,858,452 | B2 | 1/2018 | Butler et al. |
| 9,881,130 | B2 | 1/2018 | Jackson |
| 9,912,378 | B2 | 3/2018 | Park |
| 9,916,555 | B2 | 3/2018 | Wible et al. |
| 9,934,486 | B2 | 4/2018 | Vargas et al. |
| 10,014,076 | B1 | 7/2018 | LaBorde |
| 10,026,287 | B2 | 7/2018 | Sarkar |
| 10,032,129 | B2 | 7/2018 | Uno et al. |
| 10,043,593 | B2 | 8/2018 | Jackson |
| 10,055,617 | B2 | 8/2018 | Reynolds et al. |
| 10,062,252 | B2 | 8/2018 | Jenkins et al. |
| 10,073,997 | B2 | 9/2018 | Vargas et al. |
| 10,074,262 | B2 | 9/2018 | Findlay et al. |
| 10,121,028 | B2 | 11/2018 | Sengstaken, Jr. |
| 10,121,029 | B2 | 11/2018 | Rabb et al. |
| 10,126,334 | B2 | 11/2018 | Sugar |
| 10,126,403 | B2 | 11/2018 | Loverich et al. |
| 10,134,253 | B2 | 11/2018 | Trivelpiece et al. |
| 10,152,862 | B2 | 12/2018 | Lax et al. |
| 10,168,417 | B2 | 1/2019 | Bulumulla et al. |
| 10,186,331 | B2 | 1/2019 | Jackson |
| 2002/0097152 | A1 | 7/2002 | Mengrone et al. |
| 2002/0113704 | A1* | 8/2002 | Hess ..... G08B 13/126 340/568.2 |
| 2003/0214402 | A1 | 11/2003 | Sheinman et al. |
| 2004/0046658 | A1 | 3/2004 | Turner et al. |
| 2004/0080421 | A1 | 4/2004 | Wunderlich |
| 2006/0202839 | A1* | 9/2006 | Vannerus ..... G08B 21/088 340/573.4 |
| 2010/0052907 | A1* | 3/2010 | Shannon ..... B62H 5/20 340/568.6 |
| 2012/0223837 | A1* | 9/2012 | Hutzler ..... G08B 13/1445 340/568.1 |
| 2013/0150028 | A1* | 6/2013 | Akins ..... H04W 4/021 455/427 |
| 2016/0371646 | A1 | 12/2016 | Loverich et al. |
| 2016/0371647 | A1 | 12/2016 | Loverich et al. |
| 2016/0379102 | A1 | 12/2016 | Ferguson |
| 2017/0195643 | A1 | 7/2017 | Mariadoss |
| 2017/0213276 | A1 | 7/2017 | Quintero Traverso et al. |
| 2017/0228566 | A1 | 8/2017 | Sengstaken, Jr. |
| 2017/0323189 | A1 | 11/2017 | Chang et al. |
| 2018/0046890 | A1 | 2/2018 | Chang et al. |
| 2018/0060625 | A1 | 3/2018 | Sankhavaram et al. |
| 2018/0137316 | A1 | 5/2018 | Fischer |
| 2018/0178822 | A1 | 6/2018 | Carter et al. |
| 2018/0196972 | A1 | 7/2018 | Lu et al. |
| 2018/0247259 | A1 | 8/2018 | Borders et al. |
| 2018/0247509 | A1 | 8/2018 | Ashkenazi et al. |
| 2018/0286195 | A1 | 10/2018 | Baker et al. |
| 2018/0293861 | A1 | 10/2018 | Sarkar |
| 2018/0307959 | A1 | 10/2018 | Pigott et al. |
| 2018/0336379 | A1 | 11/2018 | Reynolds et al. |
| 2018/0373906 | A1 | 12/2018 | Lee et al. |

* cited by examiner

WIRELESS SECURITY AND ASSISTANCE SYSTEM

BACKGROUND OF THE INVENTION

Field of the Invention

This invention relates to security and/or assistance systems for portable articles and, more particularly, to wireless sensors that can be secured to a portable article.

Background Art

It is known to provide security systems using sensors on portable articles that continuously generate signals that can be monitored to track the location of the articles, as within a business in which the articles are displayed. One such category of sensor is a wireless sensor. These wireless sensors can be designed so that a detectable alarm is generated if the article with the associated sensor is moved outside of a certain predetermined area.

These security systems are commonly associated with articles such that would-be thieves might be able to separate the sensor from the article and thereby abscond with the article without detection. For example, the sensor might be placed loosely within a purse or another type of monitored article that has a suitable receptacle. Alternatively, the sensor might be secured inside or outside of an article through a mechanical-type connection, such as a mechanical clasp, or an adhesive, that might be defeated to separate the sensor from the article without detection.

With an increasing number of expensive, portable articles being displayed, and accessible to be handled by potential purchasers, the need for better, affordable and reliable security systems remains pressing. It is also desirable to utilize these systems to provide improved assistance to customers.

SUMMARY OF THE INVENTION

The invention is generally directed to a wireless assistance system for monitoring portable articles and enhancing user information and assistance.

In one form, the system includes a central alarm unit (CAU) comprising a programmed controller operatively associated with a CAU wireless communication circuit and a CAU alarm device. At least one wireless sensor comprises a programmed controller operatively associated with a sensor wireless communication circuit for communicating with the CAU wireless communication circuit. A tamper detection circuit is configured to determine if the wireless sensor is in an operative state on a portable article being monitored. An alert signal device generates an alert signal if the tamper detection circuit determines that the wireless sensor is not in the operative state. A user input device receives manual input commands. The CAU is programmed to periodically determine distance between the wireless sensor and the CAU and selectively operates in a programming mode and responsive to manual input commands to determine a normal distance of the article being monitored from the CAU. The CAU is programmed to define a first zone as the normal distance plus a first select amount and a second zone as the normal distance plus a second select amount, greater than the first select amount. In an arm mode, if the CAU determines that the wireless sensor is in the second zone then the CAU causes the wireless sensor to generate a warning alert signal. If the CAU determines that the wireless sensor is outside the second zone, then the CAU causes the wireless sensor to generate an alarm alert signal.

It is a feature that the tamper detection circuit comprises a tether that in conjunction with the wireless sensor extends fully around a part of a portable article being monitored with the wireless sensor in its operative state.

It is another feature that the tamper detection circuit comprises a tether that extends fully around a part of an article being monitored with the wireless sensor in its operative state.

It is another feature that the tamper detection circuit comprises a tether that defines at least part of an electrical circuit path and the tamper detection circuit is configured to generate the alert signal in the event that the electrical circuit path is interrupted.

It is still another feature that the CAU generates an alarm alert signal if the wireless sensor is outside the second zone.

It is still another feature that the CAU generates an alert signal if communication is lost with the at least one wireless sensor.

It is a further feature that the CAU is programmed to generate the alarm alert signal until the CAU is switched to a disarm mode.

It is still a further feature to provide a server in communication with the CAU and wherein the CAU periodically transmits messages to the server on status of the wireless sensor.

It is yet another feature that the wireless sensor comprises a motion detector and the wireless sensor sends signals to the CAU responsive to movement of the portable article being monitored and the server stores data on movement of the portable article being monitored.

It is still another feature that the CAU is programmed, responsive to receipt of a manual input commend from a wireless sensor in an arm mode, to communicate with the server to send a message requesting assistance at the wireless sensor.

It is still a further feature that the system comprises a help module comprising a programmed controller operatively associated with a help module wireless communication circuit for communicating with the CAU wireless communication circuit and comprising a call button. The system is programmed to send a message requesting assistance at the help module responsive to activation of the call button.

It is another feature that the normal distance is determined responsive to a number of times that a manual input command is received from the wireless sensor in the programming mode.

It is a further feature to provide a server in operative communication with the CAU and the server sends an SMS message to request assistance at the help module.

It is still another feature that the help module comprises an indicator that is activated responsive to activation of the call button and the indicator is canceled responsive to assistance being provided at the help module.

Further features and advantages of the invention will be readily apparent from the specification and from the drawings.

DETAILED DESCRIPTION OF THE PREFERRED EMBODIMENT

A wireless security and assistance system disclosed herein uses a base or central alarm unit (CAU) that can communicate with at least twenty-four wireless sensors, such as loss prevention sticker (LPS) sensors. Each LPS sensor is tethered or otherwise affixed to the portable article it is protecting by, for example, a wire, or the like. The system also uses help modules, which are stationary modules without alarm, for requesting help only. The communication between the LPS sensors, the help modules and the CAU is wireless using Ultra WideBand (UWB) technology. Distance is determined using time-of-flight principals. Other forms of wireless communication could be used, such as Bluetooth, Wi-Fi, Cellular wireless, infrared, or the like. Likewise, distance could be determined using received signal strength, as is apparent. Each LPS sensor will report to the CAU the distance, the status of the sensor and if the LPS sensor is in movement.

Each LPS sensor periodically broadcasts its ID to the CAU and broadcasts its ID with an alarm code if an alarm condition is found, such as the wire being cut. The CAU receives the alert signal if the wire is cut and can use the periodic broadcast from the LPS sensor to determine which zone an LPS sensor is located in and provide an alert or an alarm if the LPS sensor is out of range.

To determine distance, the program measures the distance between two points by measuring the time interval of signal transmission using the following equation:

$$\text{Distance}=Td*\text{Light speed}$$

Particularly, the CAU transmits a signal to the LPS sensor, the LPS sensor then replies to the CAU, and then the CAU replies back to the LPS sensor. This gives the following variables: Tround1=Time difference between the CAU sending a signal to LPS and receiving a reply; Treply1=Time difference between the LPS receiving the signal and replying to the CAU; Treply2=Time difference between the CAU receiving the signal and replying to the LPS; and Tround2=Time difference between the LPS sending a signal to the CAU and receiving a reply.

Through mathematical calculation, the following formula can be derived:

$$Td = \frac{(Tround1 * Tround2 - Treply1 * Treply2)}{(Tround1 + Tround2 + Treply1 + Treply2)}$$

Figure 1:
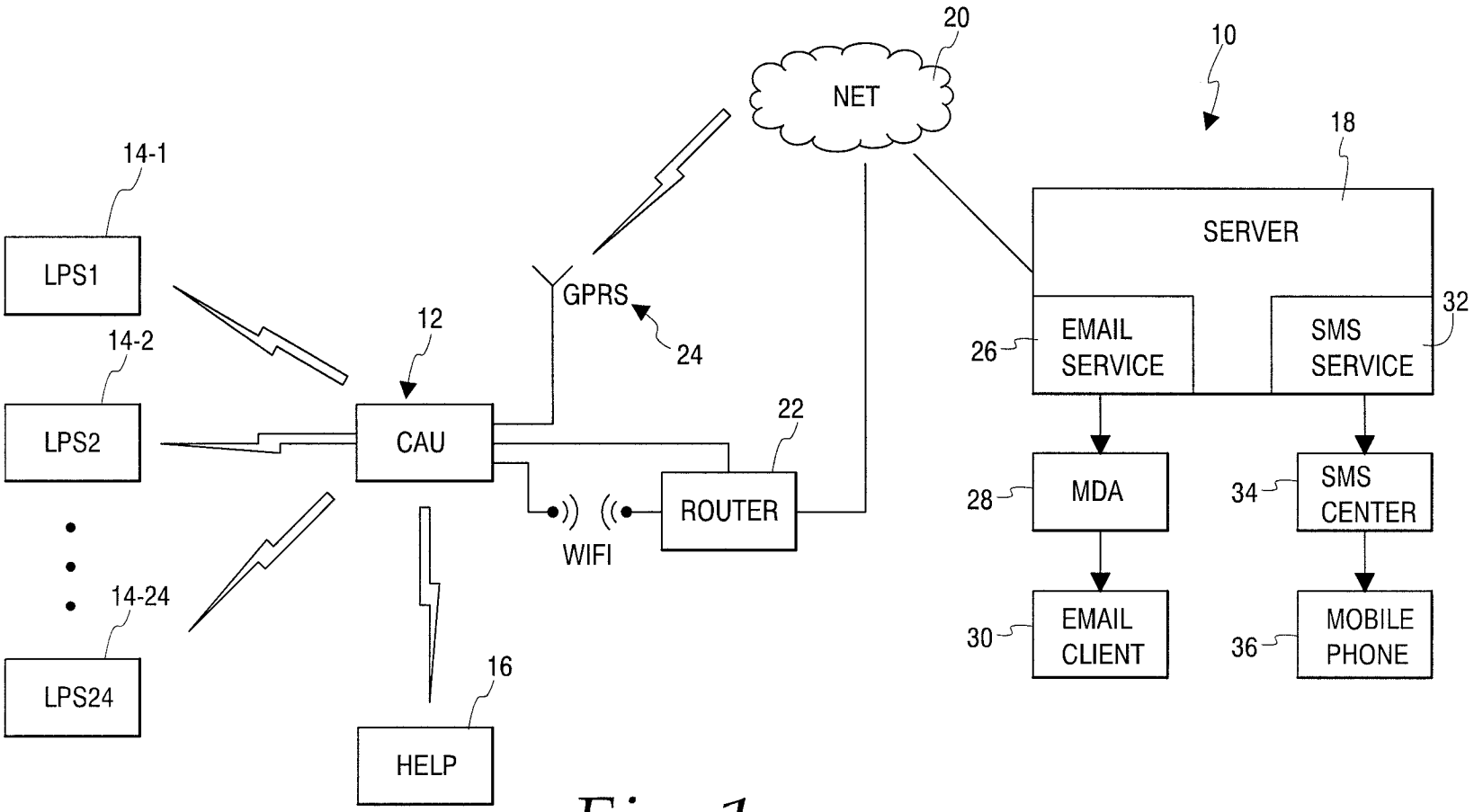
FIG. 1 is a block diagram of a wireless security and assistance system for monitoring portable articles, according to the invention.

Referring to FIG. 1, a wireless assistance system 10 for monitoring portable articles is illustrated in block diagram form. The illustrated system 10 comprises a CAU 12 and up to twenty-four LPS sensors, with LPS1 14-1, LPS2 14-2 and LPS24 14-24 being illustrated. Each of these LPS sensors is similar in construction except for having a unique ID and optionally having a particular securing assembly, as described below. For simplicity, the LPS sensors are referenced generically with the numeral 14. The system 10 also includes one or more help modules 16 connected to the CAU. A server 18, which may be a client server, or a cloud server, or the like, communicates with the CAU 12 through a network 20 in any known manner, such as via a WIFI Router 22 or General Packet Radio Service (GPRS) 24.

The cloud server 18 may take any known form and comprises one or more processing systems and memory devices conventionally programmed for cloud applications, as is well known. The system 10 herein is not dependent on the particular form of the cloud server other than using features as described herein.

The server 18 includes an email service application 26 communicating via a mail delivery agent (MDA) 28 to an email client 30; and a Short Message Service (SMS) application 32 communicating via messaging with an SMS Center 34 to a mobile phone 36. The email client 30 and the mobile phone 36 represent any such devices that may be used with the system herein in the manner described below.

Figure 1A:
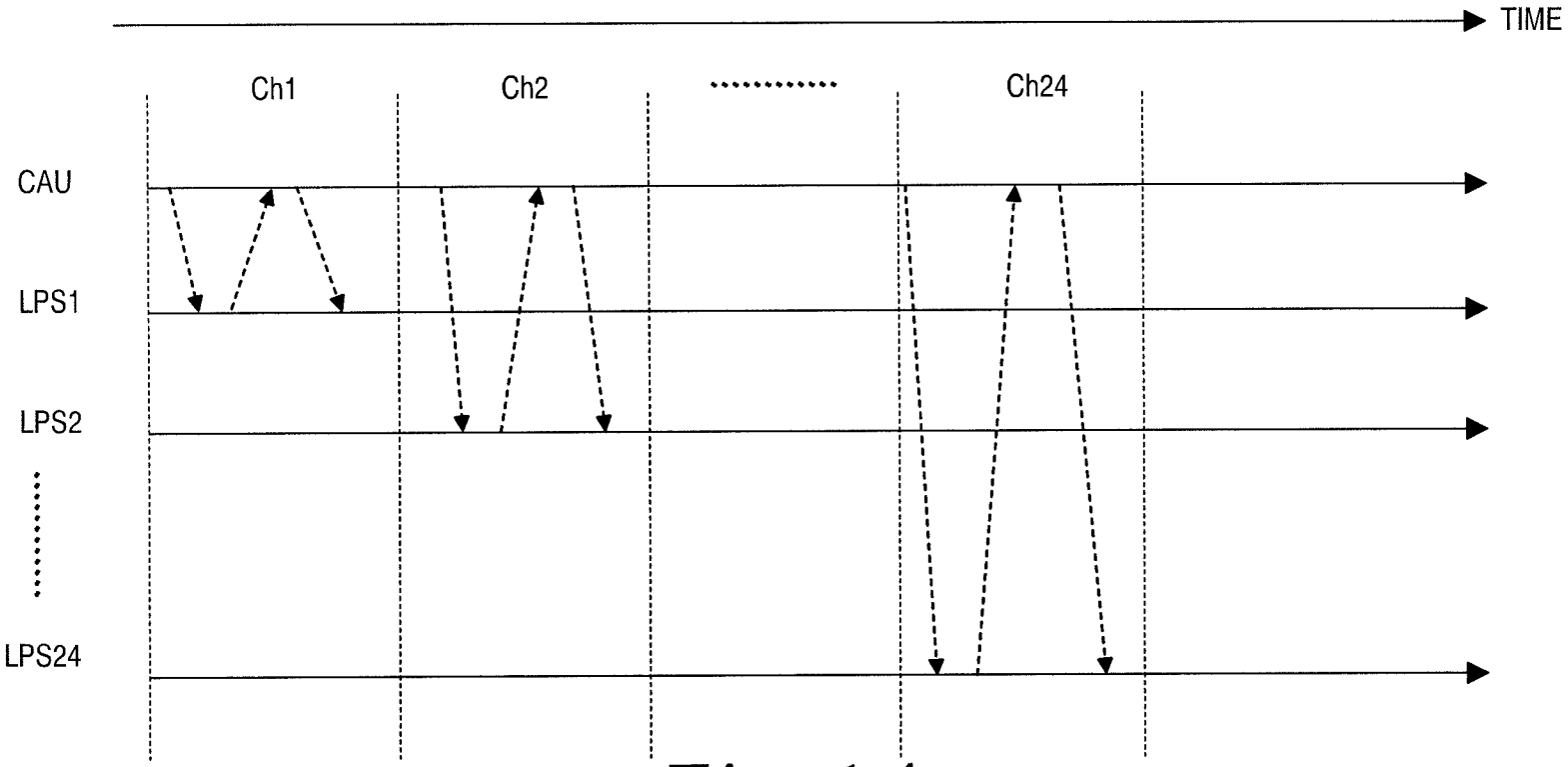
FIG. 1A is a timing diagram illustrating communication between a central alarm unit (CAU) and loss prevention sticker (LPS) sensors for the system of FIG. 1.

The CAU 12 communicates with the LPS sensors 14 using time division multiplexing, as illustrated in FIG. 1A. Each LPS sensor 14 occupies a channel, or time slot. For example, LPS1 occupies channel Ch1. For determining proximity three signals are transmitted between the CAU 12 and each LPS sensor 14 as shown and as described above. Although not shown, the help module(s) 16 would occupy separate time slots.

The help module 16 is generally similar to the LPS sensors 14, except there is no securing function. The help module 16 is used for requesting assistance, as described below. Particularly, in accordance with the invention, the system 10 is configured to provide a security function as well as an assistance function. A call button is used on each LPS sensor 14 and the help module 16 to request assistance. A request for assistance is forwarded from the CAU 12 to the cloud server 18 which sends a message, such as an SMS text message, to the mobile device 36. Typically, the mobile device 36 is carried by an employee in the store who can then provide assistance at the location of the help module 16 or the portable article being monitored, as discussed in greater detail below.

Figure 2:
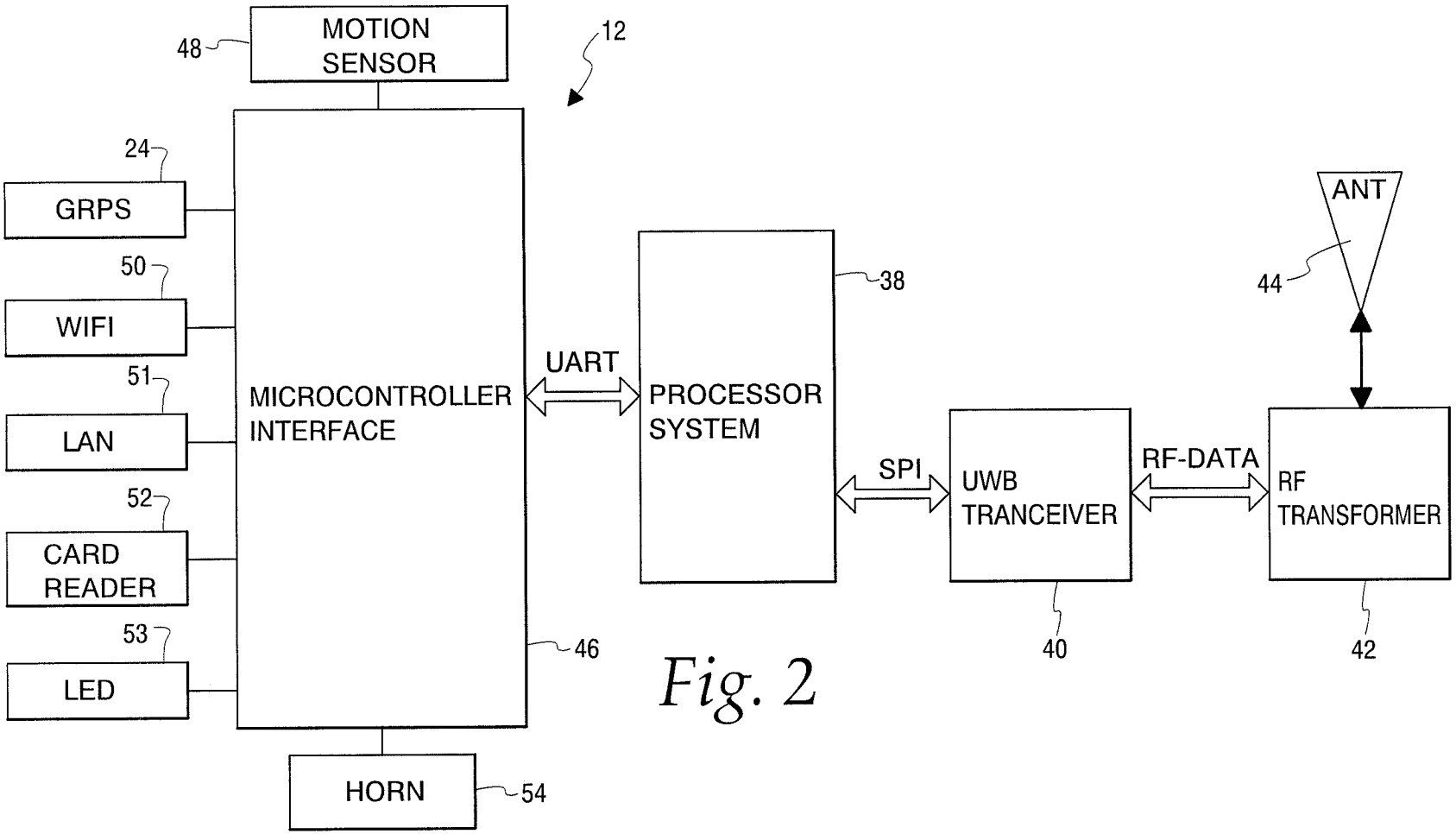
FIG. 2 is a block diagram of the CAU of FIG. 1.

Referring to FIG. 2, a block diagram illustrates the devices of the CAU 12. The CAU 12 includes a processor system 38. The processor system 38 may comprise a programmed NRF52832 multiprotocol system-on-chip. The processor system 38 comprises a programmed controller having a processor and memory and communication circuits, as is known. The processor system 38 includes a software stack that can host end user applications and has interfaces to connect to peripherals.

The processor system 38 is connected via an SPI data in and out link to a UWB transceiver 40. The UWB transceiver 40 may be a DW1000 transceiver which operates as a radio to communicate RF-Data with an RF transformer 42 having an antenna 44. The processor system 38 is also connected to a microcontroller interface 46 such as an STM32 integrated circuit for interfacing with peripheral devices. The peripherals comprise a motion sensor 48, the GPRS 24, a WIFI interface 50, a local area network (LAN) interface 51, a card reader 52, an LED indicator 53 and an alarm horn 54.

The devices forming the CAU 12 are enclosed in a conventional housing, not shown. The motion sensor 48 can sense if the housing of the CAU 12 is picked up off a countertop. The card reader 52 may be an RFID reader, or the like, and is used for setting operating modes and for controlling users. The horn 54 is used to generate an audible signal if an alarm condition is present. The LED indicator 53 is used to indicate the presence of an alarm condition or act as a power indicator.

Figure 3:
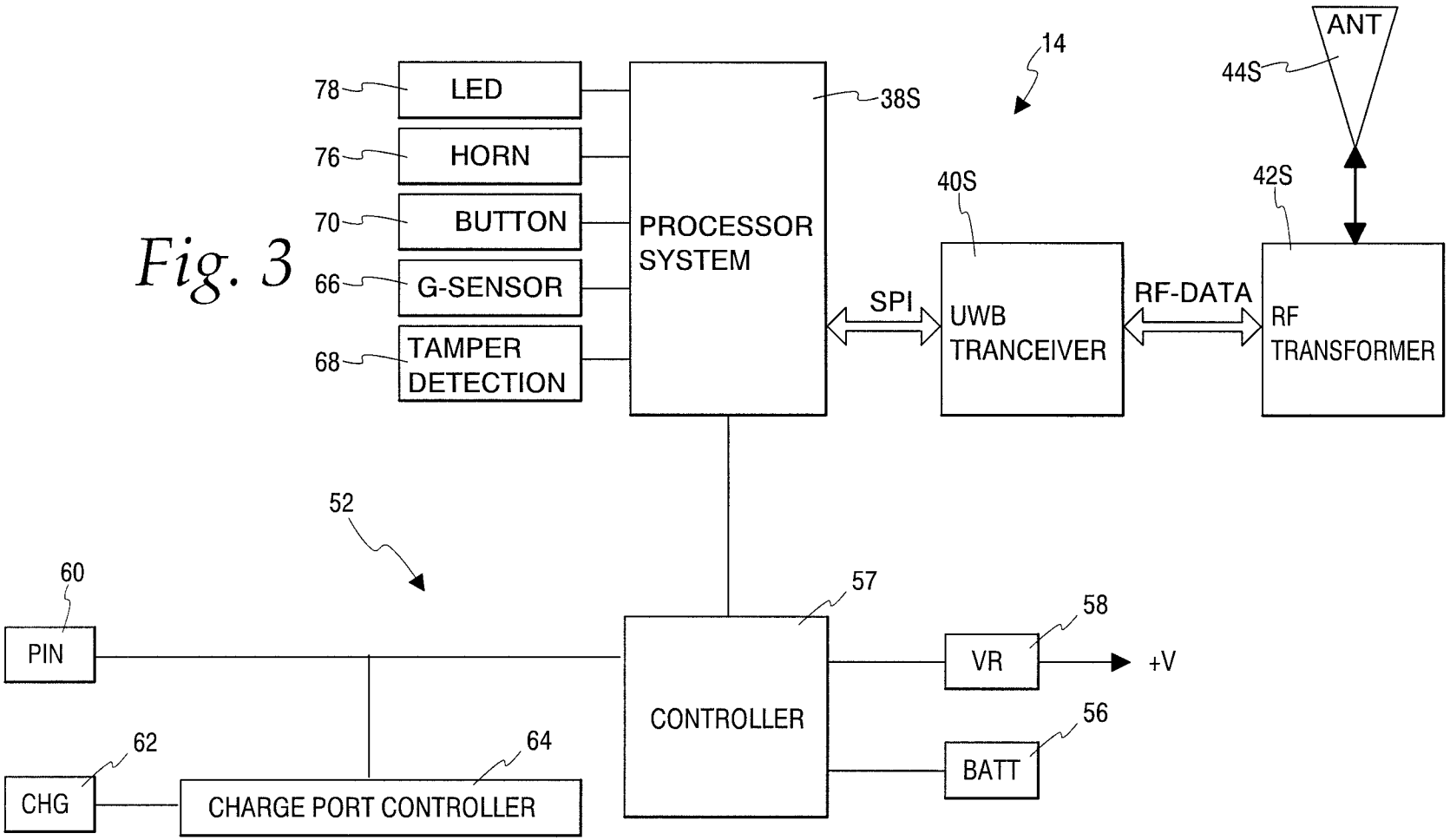
FIG. 3 is a block diagram of an electrical circuit for the wireless alarm LPS sensors of FIG. 1.

Referring to FIG. 3, a block diagram for electrical circuits forming the LPS sensor 14 is illustrated. The LPS sensor 14 comprises a processor system 38S, a UWB transceiver 40S, an RF transformer 42S and an antenna 44S. These devices correspond to the similarly numbered devices in the CAU 12 and discussed relative to FIG. 2. The processor system 38S, and other devices, are powered by a battery 56 connected to a battery charge management controller 57. The controller 57 is connected to a voltage regulator 58 which provides power to the remaining circuitry via +V. The controller 57 is coupled to a pin 60 which allows the LPS sensor 14 to be optionally connected to the CAU 12 for charging of the battery 56. Alternatively, a charge input 62 may comprise, for example, a USB connector for connecting to a power source via a USB cable. The charge connector 62 is coupled via a charge port controller 64 to the pin 60. The charge port controller 64 may be a TPS2511 DGM circuit.

The processor system 38S is connected to various input circuits including a motion sensor, or G-sensor, 66, such as an accelerometer, a tamper detection circuit 68 and a help/calibrate button 70. The tamper detection circuit 68 may be of many different constructions. For example, the tamper detection circuit 68 may comprise a push button (not shown) which is activated when the housing 16 is secured to the portable article. If the housing 16 is separated from the article, then the push button is released, as is known. Alternatively, the tamper detection circuit 68 may utilize a tether (not shown). The tether may be of the form illustrated in co-pending application Ser. No. 15/426,509, the specification of which is incorporated herein. The tether may be a flexible cord with a connector at one end that can be releasably joined to the sensor 14 to complete an electrical circuit path. The tether could alternatively have a fixed shape, the tether could have a free end that can be directed through an opening in an article to be monitored or a fully surrounded capture and arrangement can be formed for the tether being wrapped continuously around the portable article. Other forms of tamper detection circuit 68 may also be used.

To locally indicate an alarm condition at the LPS sensor 14, the processor system 38 is connected to a horn 76 and an LED indicator 78. As is apparent, additional LED s could be included as necessary or desired.

Figure 4:
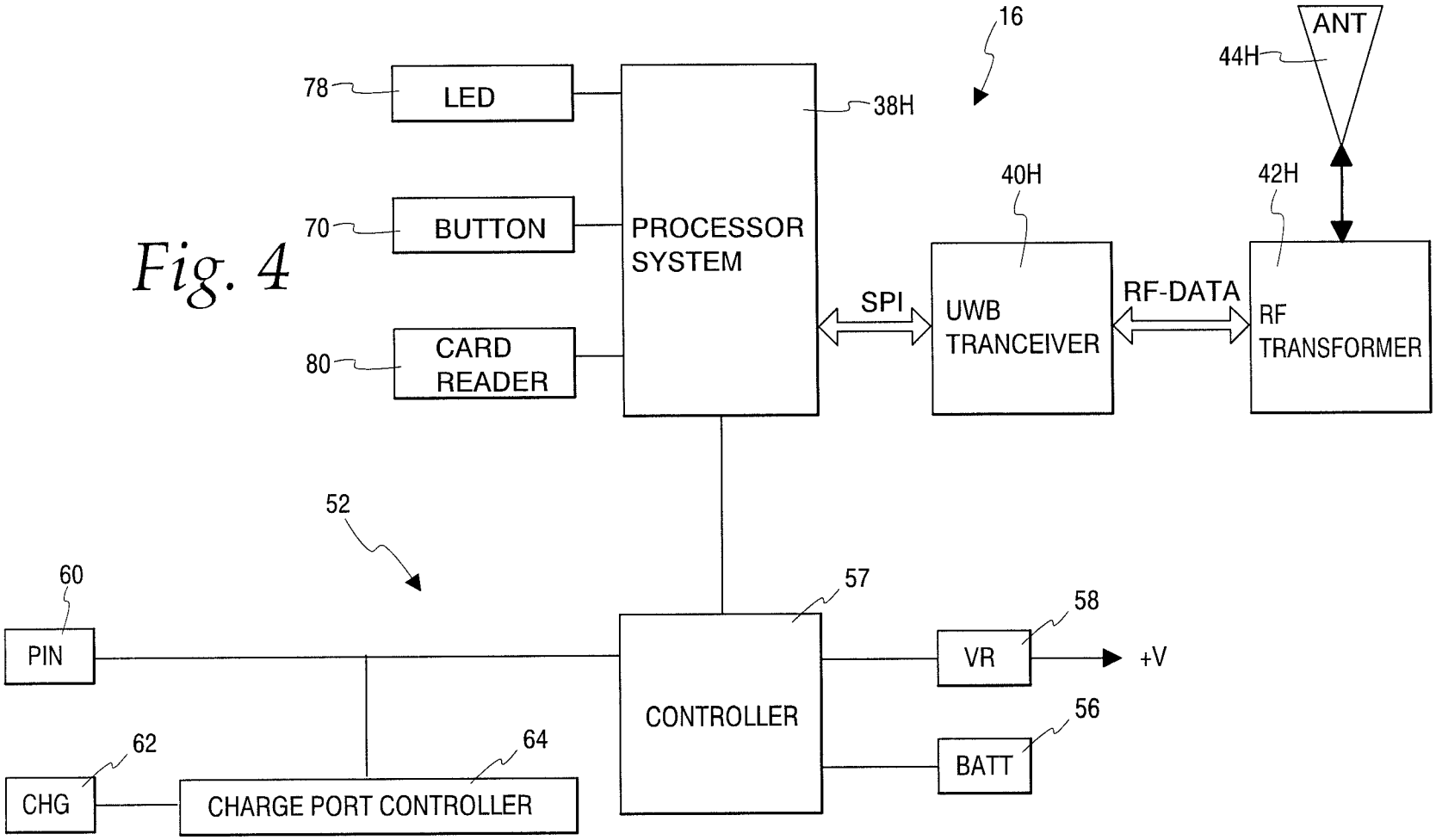
FIG. 4 is a block diagram of an electrical schematic for a help module of FIG. 1.

Referring to FIG. 4, the help module 16 uses a circuit that is generally similar to the LPS sensor 14, shown in FIG. 3. Therefore, similar devices are illustrated with similar numerals and are described above relative to FIG. 3. The help module 16 differs in that there is no tamper detection circuit or horn and the help module includes a card reader 80. The card reader 80 is an RFID card reader used for reading user cards, discussed above.

The CAU 12 is programmed to send information to the cloud server 18 anytime there is an event. The events includes movement of an LPS sensor 14, a warning on an LPS sensor 14, an alarm on an LPS sensor 14, low battery on an LPS sensor 14, or if help is required. The CAU 12 will have four modes of operation, namely, a programming mode, an arm mode, a disarm mode and an alarm mode.

Each article being monitored will have a predetermined desired location, selected by the store. The distance from that location to the CAU 12 will defined a "normal distance" from the CAU 12, generally being no more than twenty feet. A programming mode is used to link the LPS sensors 14 to the system 10 and to determine and set the normal distance from the CAU 12. If the CAU 12 is in the programming mode, then the help/calibration button 70 on a select LPS sensor 14, see FIG. 3, is depressed to link the select LPS sensor 14 to the CAU 12 and set the original distance for the select LPS 14 and will associate it with the ID of the select LPS. The button 70 will be depressed a select number of times, as described below, to set the normal distance.

Once the CAU 12 records the normal distance for a select LPS sensor 14, then the CAU 12 defines a first zone as the normal distance plus a first select amount and a second zone as the normal distance plus a second select amount, greater than the first select amount. For example, if the normal distance is six feet, then the first zone may be, for example, six to nine feet from the CAU 12. The second zone may be nine feet to twelve feet from the CAU 12.

The above procedure is used to link any and all LPS sensors 14 to the CAU. Once linking is complete, then the system will transition from the programming mode to the disarm mode. If the CAU 12 is in the disarm mode, then it will transition into the arm mode either manually or after two minutes.

In the arm mode, the CAU 12 monitors all the linked LPS sensors 14 for position, movement and status of the tamper detection circuit 68. When a select LPS sensor 14 leaves zone 1, and enters zone 2, there will be a warning beep every 5 seconds at the select LPS sensor 14. If the select LPS sensor 14 returns to zone 1, then the beep stops, and everything returns to normal. If the select LPS sensor 14 moves outside zone 2, then the select LPS sensor 14 goes into alarm mode and the CAU 12 goes into alarm mode. Bringing the select LPS sensor 14 back to zone 1 will stop the beep in the select LPS sensor 14, but not in the CAU 12.

If the help/calibrate button 70 on a select LPS sensor 14 is pressed while the CAU 12 is in the arm mode, then the CAU 12 will send a message to the cloud server 18 asking for assistance. The cloud server 18 will send an SMS message to the mobile device 36 identifying the select LPS sensor 14.

The CAU 12 goes into the alarm mode if an LPS sensor 14 is out of zone 2 or any of the tamper detection circuits are open. The CAU 12 will remain in the alarm mode until it is stopped and put into the disarm mode. Once the CAU 12 is armed again, it will go into alarm for the LPS sensor 14 that created the original alarm. The LPS sensor 14 that is on alarm will stay in alarm until it is disconnected from the CAU 12.

The CAU 12 will be placed into a particular mode using an RFID card at the card reader 52. There are two kinds of RFID cards. One is a "master" card and the other is a "user" card. The master card is only used to add or delete user cards. The user cards are only used to arm or disarm the system. The first card presented to the CAU 12 will automatically be considered the master card.

To add a new user, the master card is swiped with the card reader 52. Any user card swiped within five seconds will be added to the system and confirmed using a beep on the horn 54. To delete a user card, the user card is swiped followed by the master card being swiped within five seconds. The deletion is confirmed with two beeps using the horn 54. To delete all cards, the master card is swiped three times with no more than five seconds between swipes. The deletion is confirmed with three beeps using the horn 54.

Each time there is any activity in one of the LPS sensors 14, a message is sent to the cloud server 18. The message will include the LPS ID number, the activity and the CAU ID number. The activity could be movement, warning beep, alarm, low battery or help. The cloud server 18 will add a time stamp to the record.

The system 10 may use several types of LPS sensors 14 for securing to devices, as discussed above. These include a stand-alone LPS sensor with a loop or tether, such as for tools and clothing. A stand-alone LPS sensor for different appliances may use a push button type of actuator. Likewise, the LPS sensor could be incorporated into a support stand for a device.

The LPS sensor 14 will have a disconnect mode in which it is not being used. The operating modes include a calibration or programming mode, an arm mode, a disarm mode, a warning mode, an alarm mode and a low battery mode. The calibration mode is discussed above and is used to link an LPS sensor and set the normal distance. The CAU 12 must be in the programming mode to add or remove the LPS sensors 14. In the arm mode, the LPS sensor 14 is normally in a sleep mode to preserve battery life. As long as the LPS sensor 14 is static, there is no reason to communicate with the CAU 12. If movement is sensed by the movement sensor 66, or the tamper detection circuit 68 is activated, then the processor system 38S wakes up and connects to the CAU 12. The CAU 12 then polls the LPS sensor 14 to determine distance from the CAU 12, as described above. The LPS sensor 14 will also send information on the status of the tamper detection circuit 68. As noted above, if the LPS sensor 14 is in zone 2, then there is a beep using the horn 76 every five seconds. If the LPS sensor 14 returns to zone 1, then the beeping stops. This is a warning mode. The LPS sensor 14 is placed in the alarm mode if the LPS is out of zone 2 or the sensor of the tamper detection circuit 68 is open. In the alarm mode, the horn 76 beeps every two seconds and the CAU 12 goes into alarm mode. To stop the alarm mode, the CAU 12 must transition to the disarm mode.

If the battery 56 in the LPS sensor 14 is low, then there will be a beep every 30 seconds. If the help/calibration button 70 is depressed and the CAU 12 is not in the programming mode, then the CAU 12 will send a message to the cloud server 18 including the ID information for the LPS sensor and the help code to request assistance. This results in an SMS message being sent to the mobile device 36, as discussed above.

If the help module help button 70, see FIG. 4, is pressed, then the information of the unit number and the code for the help module 16 is sent via the CAU 12 to the cloud server 18. The relevant person will receive an SMS message of the help request at the mobile device 36. The LED 78 will be blinking while the request for help is pending. In order to cancel the request, the employee has to swipe the RFID user card using the card reader 80 to cancel the request. The ID of the user card will be sent to the cloud server 18. Once this is done, then the blinking LED 78 will be turned off.

The cloud server 18 is programmed with a cloud application program which will define different types of users. An administrator, who has the right to add LPS sensors 14 and a CAU 12, a manager, a sales person and regular users. A manager will manage the store by department. The salesperson has no rights and will only receive text messages for alarms and help requests. A regular user can open the application and receive status and run reports.

The manager information will include name, mobile phone number and will be in charge of at least one department. The responsibilities include assigning a CAU 12 to the department, assigning the LPS sensors 14 to the different articles to be monitored, and assigning salesperson to a specific CAU 12, by day and shift. The salesperson information will include the name and mobile phone number. The salesperson will have the specific CAU 12 that he or she is connected to and a flag for active/non-active. Thus, if the salesperson is not working, then the salesperson will not receive text messages.

The CAU 12 will be added with the latitude and longitude coordinations of the location, name of store, name of department, City and Country. The LPS sensors 14 are added automatically once linked to a CAU 12, as discussed above. The information associated with the CAU 12 will carry over. Additional data may include the type of item to be protected such as phones, tablets, laptops, cameras, etc. This information is added to each LPS sensor 14.

The cloud server 18 may include a graphical interface showing how many times each item has been picked up, how many alarms have been activated, how many help calls were made, and the like. Reports may be generated which include number of alarms, number of pick ups and number of help requests. This information can be shown in numerical and graphical mode. This may be broken out by stores, region, etc., as well as by SKU (Stock Keeping Unit). As such, the system 10 operates not only as a security system, but also an assistance system.

Figure 5:
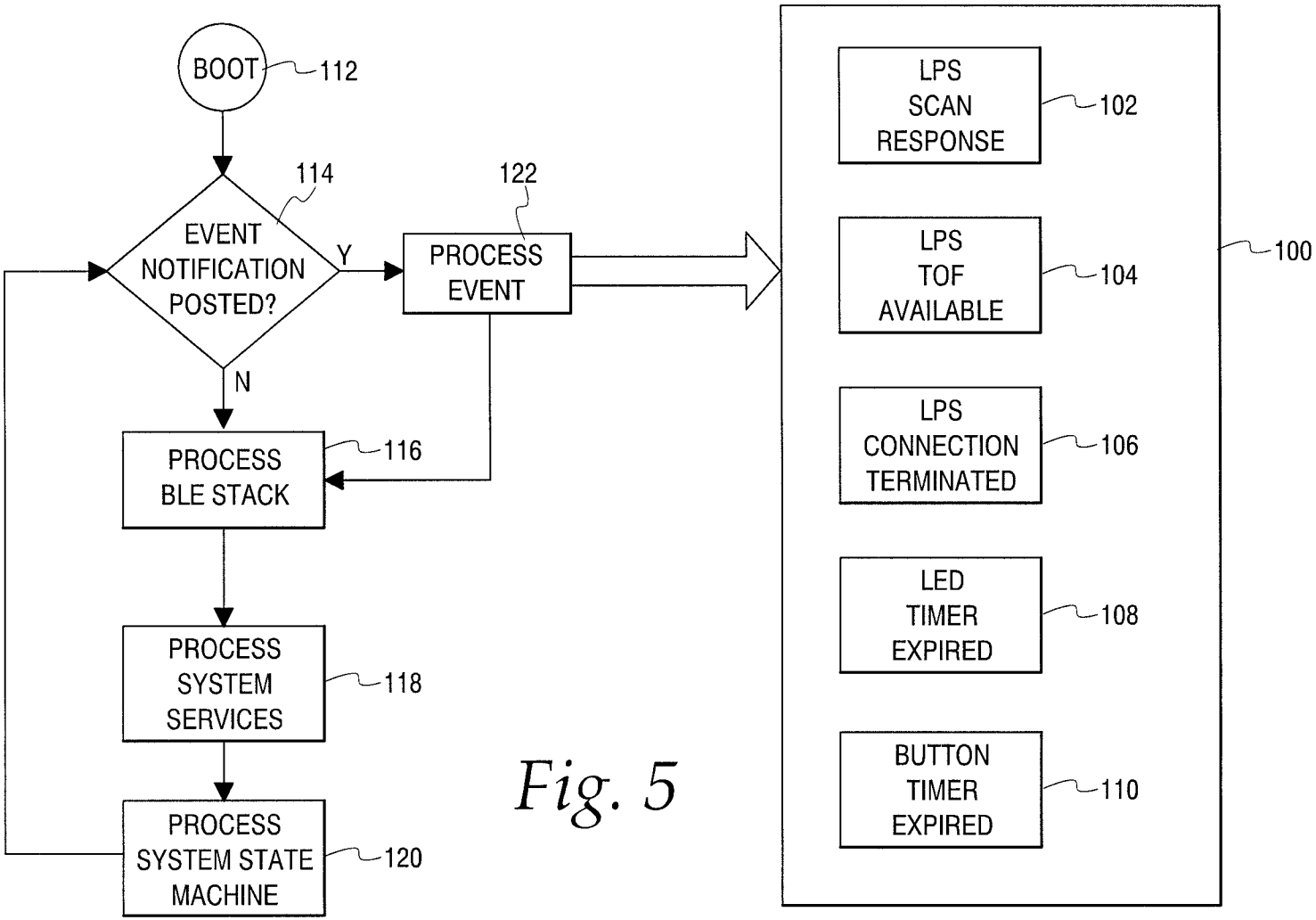
FIG. 5 is a flow diagram illustrating an algorithm implemented by the CAU of FIG. 2.
Figure 6:
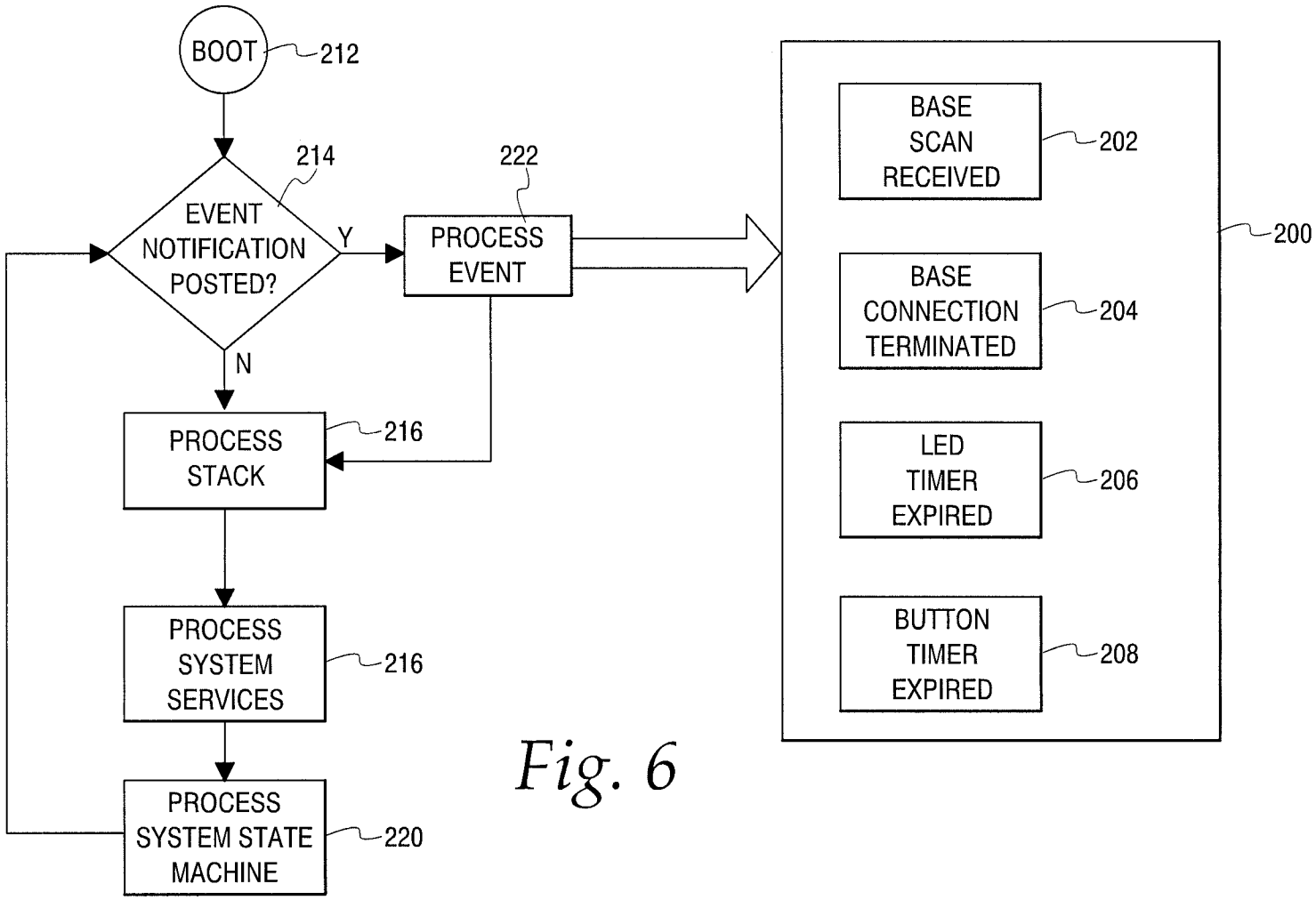
FIG. 6 is a flow diagram of an algorithm implemented by the LPS sensors of FIG. 3.

Referring to FIG. 5, a flow diagram illustrates the main loop implemented in the CAU processor system 38. FIG. 6 illustrates the main loop implemented in the LPS processor system 38S. During iterations of the main loop, the processor system service blocks may post event notifications to the events notification que. When this happens, the events are processed one by one at the start of the next loop iteration. The CAU processor system 38 includes an event notification list 100, see FIG. 5, while the LPS processor system 38S includes an event notification list 200, see FIG. 6.

The CAU event notification list 100 includes the following events: LPS scan response 102; LPS time-of-flight (TOF) available 104; LPS connection terminated 106; LED timer expired 108; and button timer expired 110. The LPS scan response 102 is a notification from the stack that an LPS sensor 14 has responded to the CAU discovery scan. Each time this event occurs, the CAU circuit 22 will attempt to establish a UWB connection with the responding LPS sensor 14. The LPS TOF available 104 has an updated distance associated with one of the LPS sensors 14. The LPS connection terminated notification 106 occurs when the stack has lost a connection with one of the LPS sensors 14. The LED timer expired notification 108 is a notification that the system LED indicator update interval has ended and it is time for the base to update the system LED indicators. The button timer expired notification 110 indicates that the push button input poll timer has expired and it is time for the CAU circuit 22 to poll its user input buttons and update relevant system variables.

The LPS event notification list 200 includes the following events: base scan received 202; base connection terminated 204; LED timer expired 206; and button timer expired 208. The base scan received notification 202 is a stack notification that indicates that a base scan signal has been received and that the LPS sensor 14 should respond that it is available for connection. The base connection terminated notification 204 is a notification in an LPS sensor that the stack has lost a connection with the CAU 12. The LED timer expired notification 206 is a notification that the system LED indicator update interval has ended and it is time for the LPS sensor 14 to update the system LED indicators. The button timer expired notification 208 indicates that the push button input poll timer has expired and it is time for the LPS sensor 14 to poll its user input push buttons and update relevant system variables.

Referring to FIG. 5, the CAU flow diagram begins at a boot node 112 at power up. This initializes hardware, UWB stack and a system state machine and initiates UWB advertisement packets. A decision block 114 determines whether or not an event notification has been posted. If not, then the stack is processed at a block 116 to manage the software stack. A block 118 processes system services, such as managing timers, interrupts, and the like. A block 120 processes the system state machine, described below. The process then loops back to the decision block 114. If an event notification has been posted, as discussed above, then the event from the list 100 is processed at a block 122 and then the program proceeds to the block 116 and continues as above.

Referring to FIG. 6, the main loop flow chart for the LPS sensor 14 is illustrated. This flow chart is similar to that of FIG. 4, with numbers in the 200 series. As such, respective blocks 212, 214, 216, 218, 220 and 222 correspond to blocks 112, 114, 116, 118, 120 and 122 of FIG. 4 and are not otherwise discussed in detail herein.

In both the CAU 12 and LPS sensors 14 alarm management is implemented via a system state machine which is serviced during main loop iteration in the respective blocks 120 and 220, above. The state machine is responsible for handling user inputs and alarm conditions based on a set of system state variables. These are updated based on a variety of factors which include the current state of the device.

Figure 7:
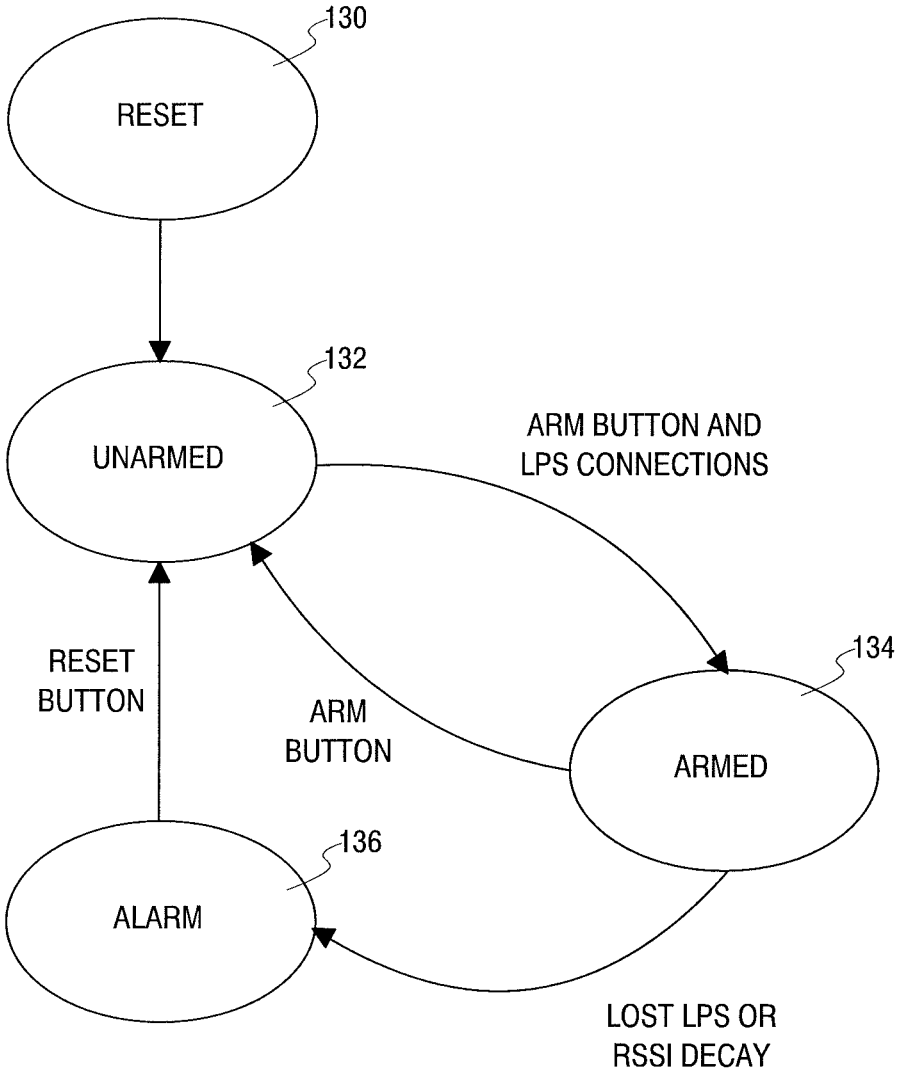
FIG. 7 is a state diagram for the CAU of FIG. 2.

FIG. 7 illustrates the state diagram for the CAU 12. The states include a reset state 130, an unarmed (or disarm) state 132, an armed state 134 and an alarm state 136. The reset state 130 is the default power-up state for the CAU 12 and is used to implement the programming mode. In this state system variables, hardware, and the stack are initialized and the main loop is started. The system state always transitions automatically to the unarmed state 132 as soon as initialization is completed.

In the unarmed state 132, the CAU 12 carries out the LPS discovery process by sending out UWB scan packets and awaiting responses. This may occur, for example, every 100 milliseconds. When responses are received, connections are established with the responding LPS sensors 14. The system remain in the unarmed state until one or more LPS connections are established and the user arms the system. The unarmed state 132 may only transition to the armed state 134.

In the armed state 134, the CAU 12 actively monitors all existing LPS connections for movement and/or alarm conditions. In the event of excessive signal degradation or lost signal, the state would transition to the alarm state 136. A transition back to the unarmed state is also possible if the user manually disarms by using the card reader 52. The alarm state 136 is entered once the CAU 12 has detected an alarm condition. In this state, the CAU 12 activates an audible alarm indicator using the horn 54. The alarm state 136 may only transition back to the unarmed state 132 via manual user operation using the RFID reader 52.

Figure 8:
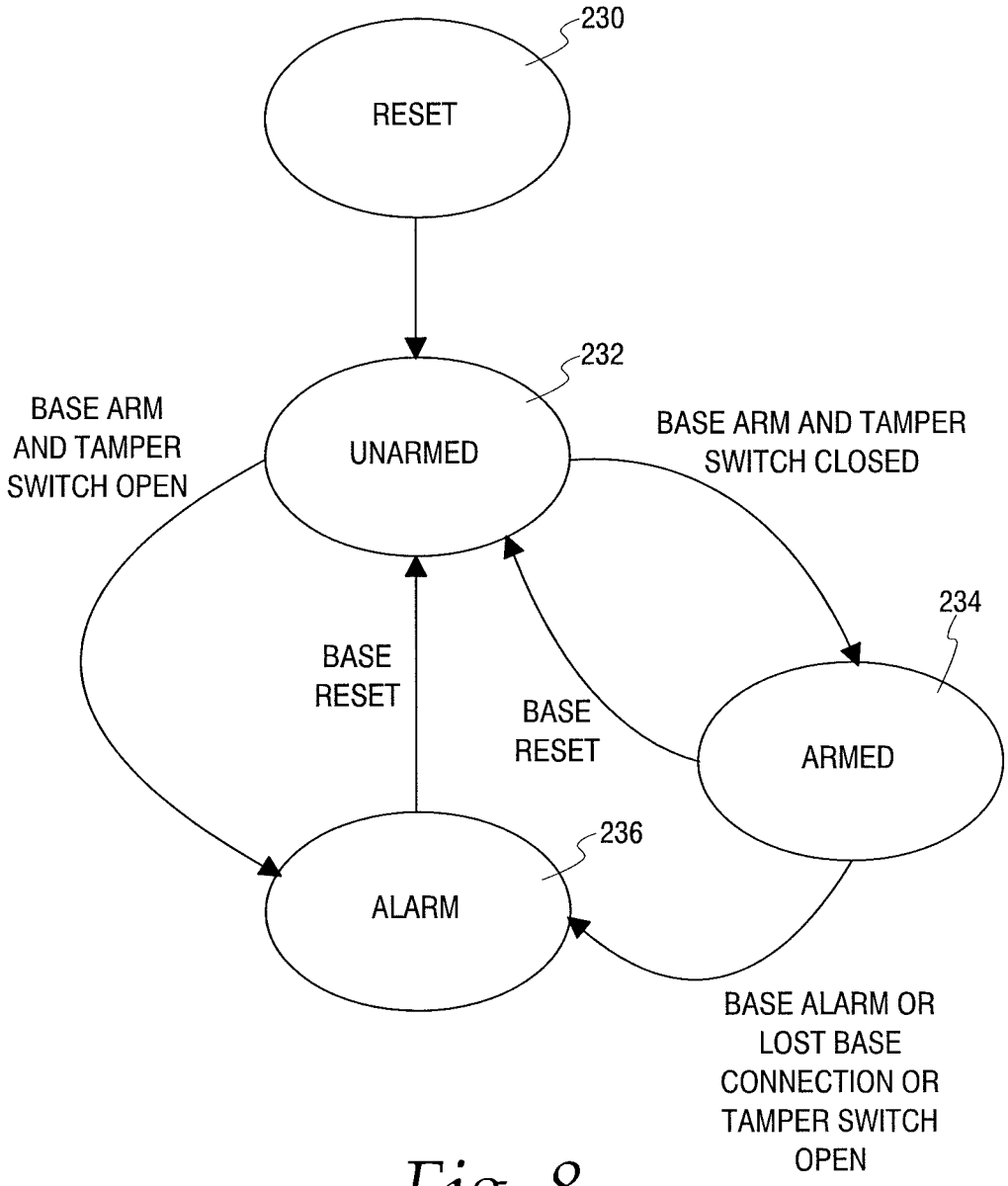
FIG. 8 is a state diagram for the LPS sensors of FIG. 3.

FIG. 8 illustrates the state diagram for the LPS sensors 14. Similar to the CAU 12, these states comprise a reset state 230, an unarmed state 232, an armed state 234 and an alarm state 236.

The reset state 230 is identical to the reset state 130 in the CAU 12. The reset state 230 transitions automatically to the unarmed state 232 after device initialization is complete. In the unarmed state 232, the LPS sensor 14 responds to the CAU scan requests, establishes a base connection, and awaits a signal from the CAU 12 to transition to the armed state 234. If an arm request is received from the CAU 12 and the tamper switch 68 is open, the LPS sensor 14 will transition to the alarm state 236. If the tamper switch 68 is closed, then the LPS sensor 14 transitions to the armed state 234.

In the armed state 234, the LPS sensor 14 responds to the CAU poll requests and monitors the tamper detection circuit 68. If a reset request is received in the CAU 12, then the LPS sensor 14 will transition back to the unarmed state 232. Otherwise, if an alarm signal is received from the CAU 12, or the UWB connection to the CAU 12 is lost, or the tamper detection circuit 68 opens, then the state transitions to the alarm state 236.

The alarm state 236 is entered if the LPS sensor 14 receives an alarm signal from the CAU 12, or its UWB connection is lost, or the tamper switch 68 opens, as noted. In the alarm state 236, the LPS sensor 14 activates a visual alarm using the indicators 78 and an audible alarm using the horn 76. The alarm state 236 may only transition back to the unarmed state 232 in response to a signal from the CAU 12.

Figure 9:
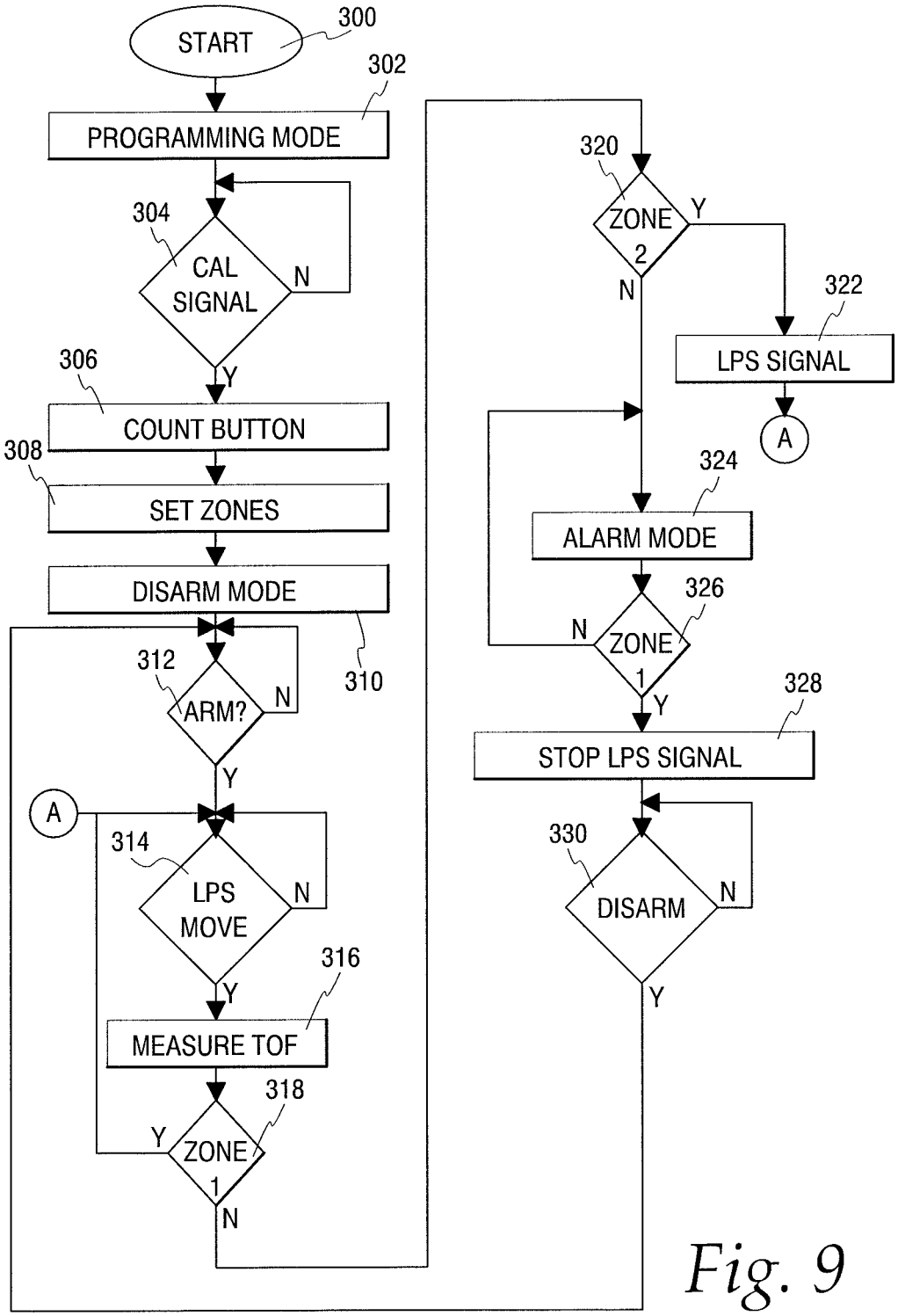
FIG. 9 is a flow diagram illustrating operation of the wireless security and assistance system of FIG. 1.

Referring to FIG. 9, a flow diagram illustrates the overall operation of the wireless security and assistance system 10 for sensing location of the portable article being monitored. The system 10 begins at a start node 300 when the system is powered on. Initially, the CAU 12 would be placed in the programming mode 302 to link the desired LPS sensors 14. As part of the programming mode, a decision block 304 determines if the calibration button 70 on a select LPS has been depressed. If not, then the system waits. Once the signal for the button depression is received, then the CAU 12 communicates with the select LPS sensor 14 and then counts button pushes at a block 306 and sets the zones at a block 308, as discussed above. The system 10 then transitions to a disarm mode at a block 310. Thereafter, the system 10 advances to a normal operation and determines if an arm mode has been set at a decision block 312.

The system 10 waits for the arm mode to be activated and then advances to a decision block 314 which determines if any LPS sensor 14 has moved as by receiving a movement signal from the LPS sensor 14. If a select LPS has moved, then the CAU 12 communicates with the select LPS sensor 14 and measures time-of-flight at a block 316 to determine distance of the select LPS sensor 14 from the CAU 12. A decision block 318 determines if the select LPS sensor 14 is in zone 1. If so, then control returns to the decision block 314. If not, then a decision block 320 determines if the select LPS sensor 14 is in zone 2. If so, then the select LPS will enter the warning mode with the signal being provided at a block 322 and the control returns to the block 314. If the select LPS sensor 14 is beyond zone 2, as determined at the decision block 320, then the CAU 12 sets the alarm mode at a block 324, as discussed above. A decision block 326 then determines if the select LPS sensor 14 has returned to zone 1. If not, then the CAU 12 remains in the alarm mode. If so, then the system stops the LPS signal at a block 328. The system 10 then waits at a decision block 330 until a disarm mode is selected at the CAU 12. Once this happens, then the system 10 returns to the decision block 312, discussed above.

Although not shown in FIG. 9, the system also alarms responsive to the tamper detection circuit 68 determining that the LPS sensor 14 is no longer in an operative state on the portable article being monitored, as is known.

The following flow diagrams illustrate different aspects of the operation of the system 10.

Figure 10B:
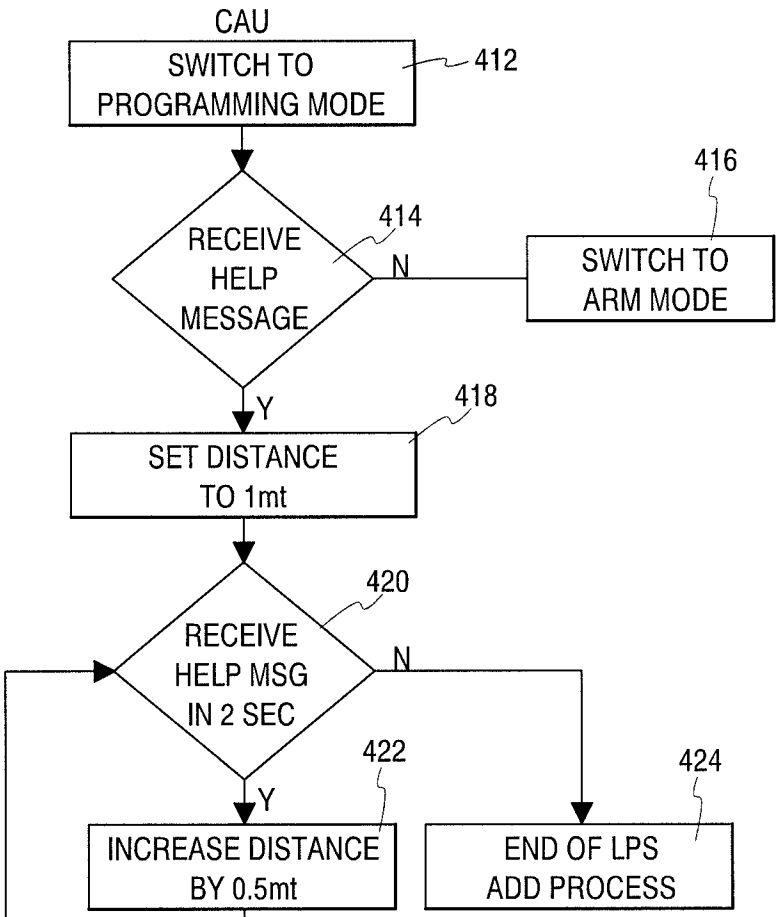
FIGS. 10A and 10B are flow diagrams illustrating steps for connecting a new LPS sensors to the CAU.
Figure 10A:
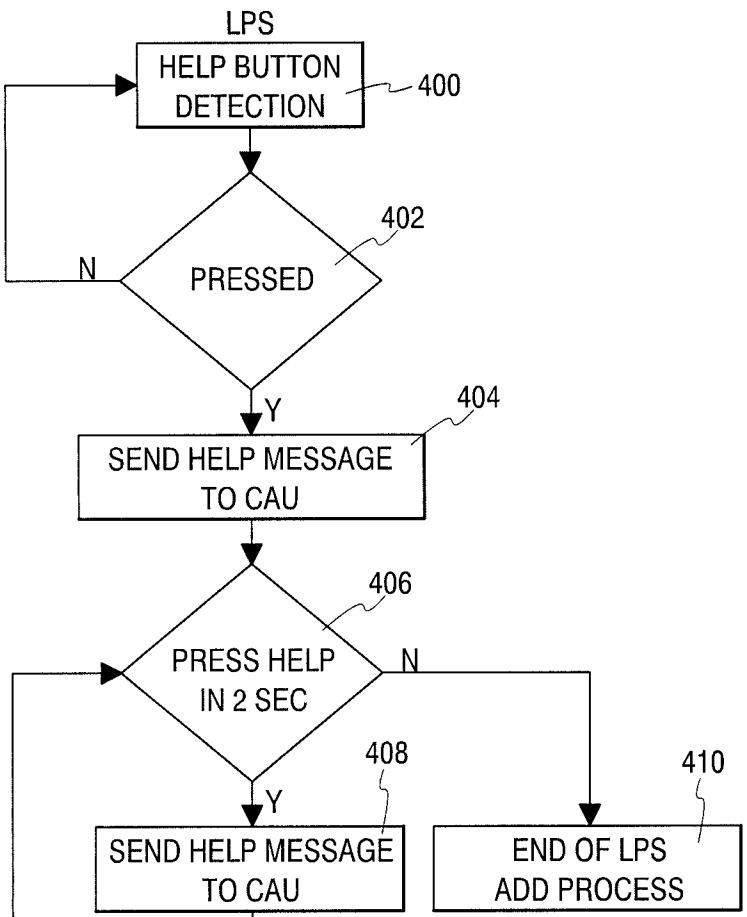

FIGS. 10A and 10B illustrate the procedure for connecting a new LPS sensor 14 to the CAU 12. When a new sensor 14 is connected to the CAU 12, it is necessary to determine the distance to be used as a normal distance for the particular LPS sensor 14, as discussed above.

Referring initially to FIG. 10A, a help button detection routine 400 in the LPS sensor 14 is illustrated. This routine is used to add sensors when the CAU is in the programming mode, see block 412 in FIG. 10B. The routine begins at a decision block 402 which determines if the help button 70 has been pressed. If not, then the control returns to the block 400. If the button 70 was pressed, then a help message is sent to the CAU 12 at a block 404. At this point the sensor 14 is connected and the distance is set to one meter. By pressing the help button 70 again, the distance is incremented by ½ meter. As is apparent, other distances and increments could be used. The user can continue to press the button 70 multiple times, waiting no longer than two seconds between presses. A decision block 406 determines if the help button 70 has been pressed within two seconds. If so, then another help message is sent to the CAU 12 at a block 408 and the routine returns to the decision block 406. If not, then the add process ends at a block 410.

The operation in the CAU 12 is illustrated in FIG. 10B which begins at a block 412 when the manager switches the CAU to programming mode, as discussed above. A decision block 414 determines if a help message is received from an LPS sensor 14. If not, then the CAU 12 switches to the arm mode at a block 416. If a help message was received, then the normal distance for the particular LPS sensor 14 is set to one meter at a block for 18. Thereafter, a decision block 420 determines if another help message is received within two seconds. If so, then the normal distance is increased by ½ meter at a block 422 and the program then loops back to the decision block 420. If not, then the LPS add process ends at a block 424.

Figure 11B:
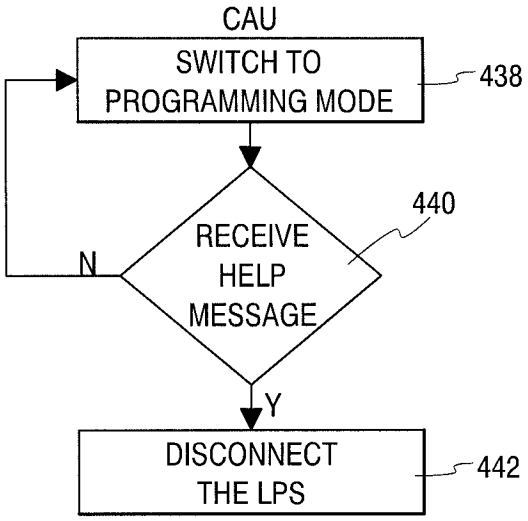
FIGS. 11A and 11B are flow diagrams illustrating steps for disconnecting an LPS sensor from the CAU.
Figure 11A:
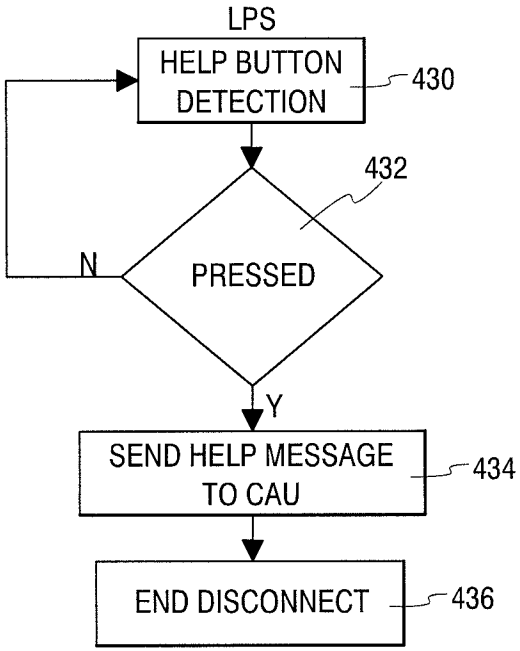

Referring to FIGS. 11A and 11B, a routine is illustrated for disconnecting an LPS sensor 14 from the CAU 12. To disconnect the LPS sensor 14, the CAU 12 must first be in the programming mode and the help button 70 on a connected LPS sensor is pressed one time.

A block 430 begins the help button detection routine in the LPS sensor 14. A decision block 432 determines if the help button 70 has been pressed. If not, then the program loops back to the block 430. If so, then a help message is sent to the CAU 12 at a block 434 and the disconnect routine ends at a block 436.

In the CAU 12, the mode is switched to the programming mode at a block 438. A decision block 440 determines if a help message is received. If not, then the program loops back to the block 438. If so, then the LPS sensor 14 that sent the help message is disconnected at a block 442 and the routine ends.

The system 10 includes a marketing function which collects information on what item is picked up and for how long the customer is looking at the item. This information is stored in a database with analytics available. The database can be in the cloud server 18, or a client server, or the like, as necessary or desired.

As described above, each LPS sensor 14 has a motion sensor 66. Each time the article carrying the LPS sensor 14 is moved from its normal location a message is sent to the CAU 12 that passes the message to the server 18. A second message is sent after movement stops for twenty seconds. The server 18 will now have the information that the specific LPS sensor 14 was lifted and was in the hands of the customer for a specific time which is calculated based on the two messages. This information can be used for displaying all of the items, specifying which items have been moved, and how many times.

Figure 12B:
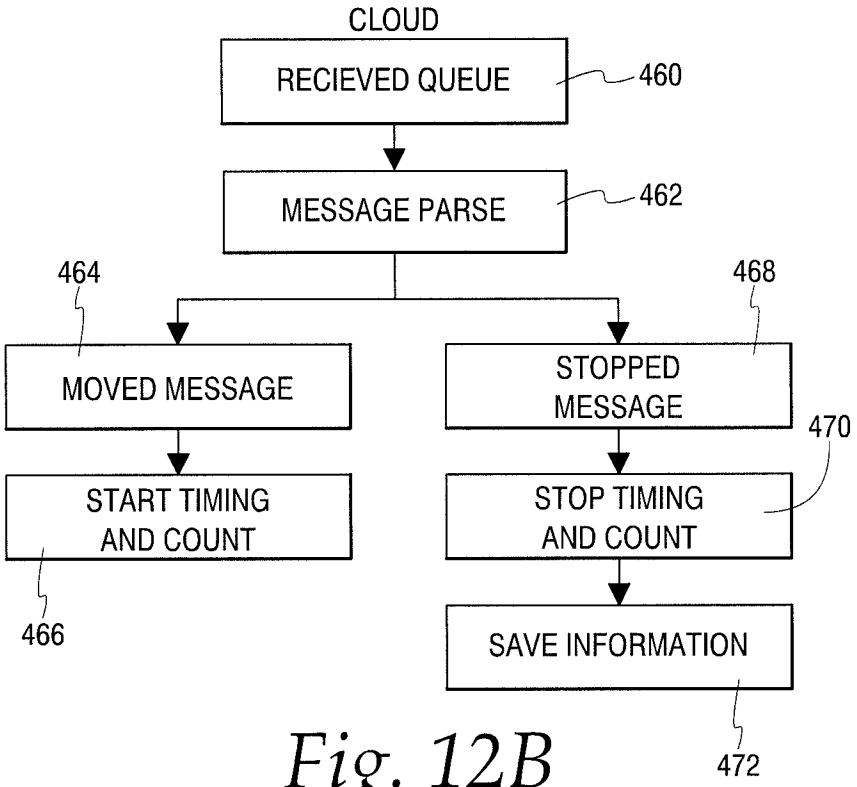
FIGS. 12A and 12B are flow diagrams illustrating operation of programs for monitoring movement of an LPS sensor.
Figure 12A:
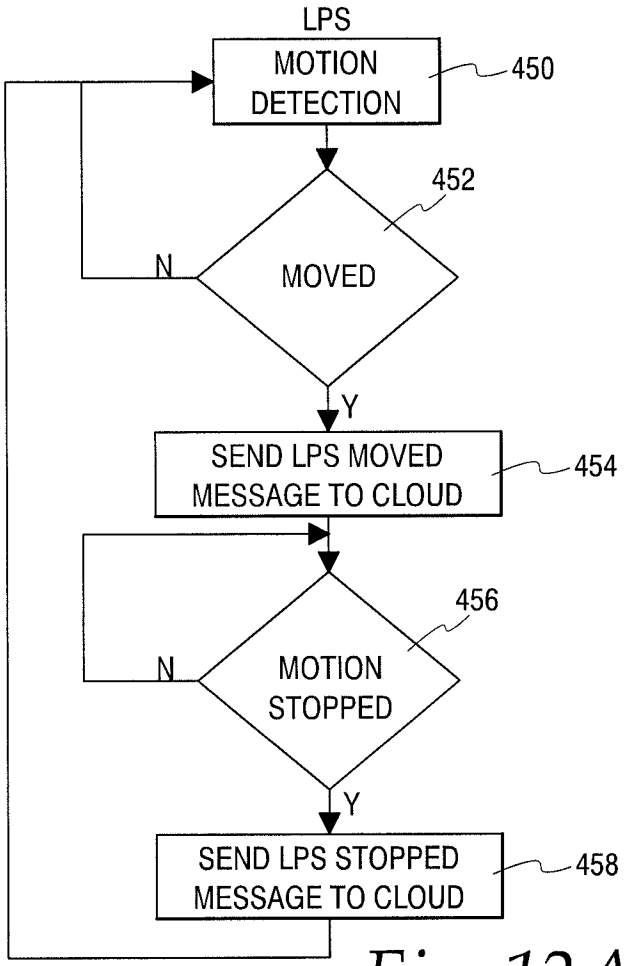

This routine is illustrated in the flow diagrams of FIGS. 12A and 12B. FIG. 12A illustrates a routine in the LPS sensor which uses a motion detection routine beginning at a block 450. A decision block 452 determines whether or not the LPS sensor 14 has been moved responsive to input from the motion sensor 66. If not, then the control loops back. If so, then the LPS sensor 14 sends a moved message to the cloud server 18 at a block 454. As noted above, the message is sent to the CAU 12 which passes it on to the cloud server 18. A decision block 456 determines if motion has stopped for a select time period, being twenty seconds in the example. If not, then the program loops back. If so, then the LPS sensor 14 sends a motion stopped message to the cloud server 18 at a block 458 and control returns to the block 450.

FIG. 12B illustrates the routine implemented in the cloud server 18. When a message is received it is placed in a received queue at a block 460. The message is later parsed at a block 462. If the message is a moved message, at a block 464, then the cloud server 18 starts a timing and count function at a block 466. If the received message is a motion stopped message, at a block 468, then the cloud server 18 stops the timing and count function at a block 470 and saves the information at a block 472 and the routine ends.

The system 10 includes a store manager function which allows a store manager to review how long it takes for a help request to be answered and which employees are responding to these requests.

As discussed above, each LPS sensor 14 has a help button 70. There may also be help modules 16 located about the store, each also having a help button 70. When the customer presses the help button 70 on an LPS sensor 14, then a message is sent to the CAU 12 which passes it on to the cloud server 18. The cloud server 18 will send a message to one or more employees regarding this help request. Once an employee responds to the customer, then the employee's RFID card is swiped on the CAU 12. The system 10 then knows which employee responded to the help request and how long it took after the request was made.

Similarly, when a customer press the help button 70 on the help module 16 a message is sent to the CAU 12 that sends the message to the cloud server 18. The LED 78 on the help module 16 will start blinking. The cloud server 18 will send a message to one or more employees regarding the help request. Once an employee responds to the help request, then the employees RFID card is swiped on the card reader 80 on the help module 16. The system 10 then knows which employee responded to the help request and how long it took since the request was made.

Figure 13B:
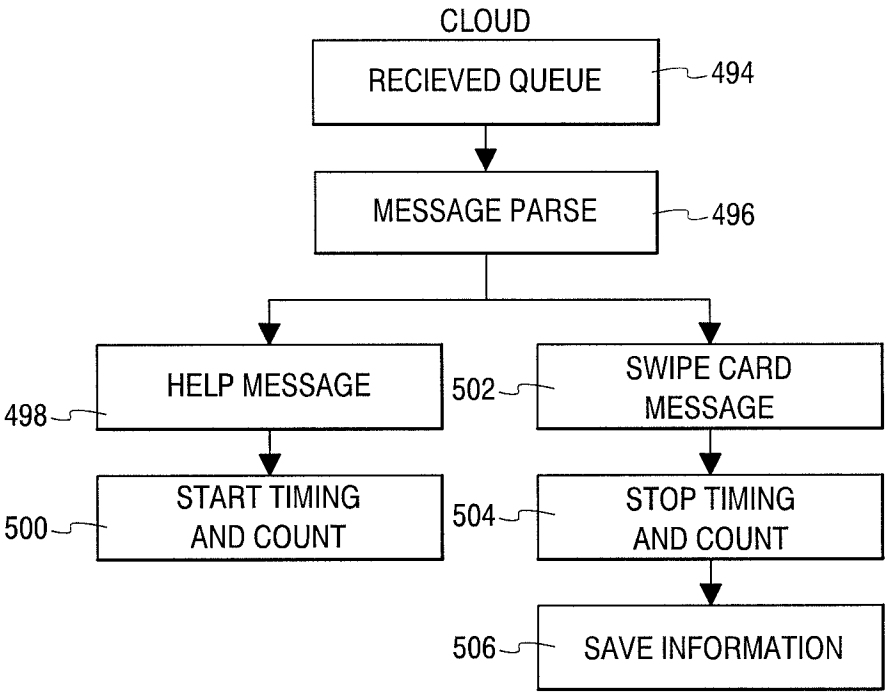
FIGS. 13A and 13B are flow diagrams illustrating operation of help system for assisting customers using the help module of FIG. 4.
Figure 13A:
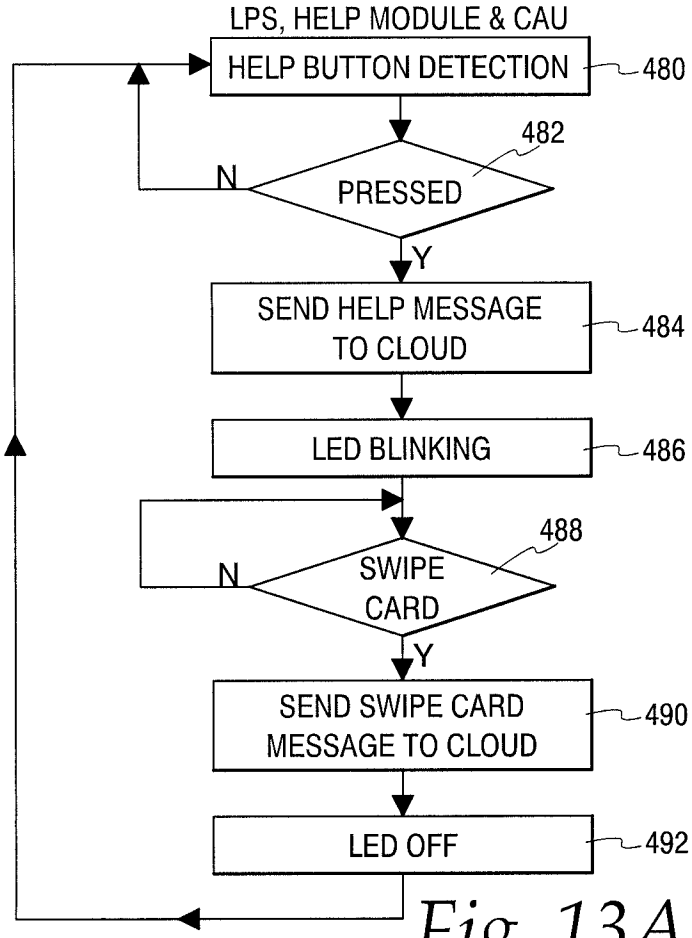

This routine is illustrated in the flow diagrams of FIGS. 13A and 13B. FIG. 13A illustrates the programming implemented at the store in the LPS sensor 14, the help module 16 and the CAU 12 for the help button detection routine 480. A decision block 482 determines if the help button 70 has been pressed. If not, then the control loops back to the block 480. If the help button 70 is pressed, then a help message is sent via the CAU 12 to the cloud server 18 at a block 484. The LED 78 begins blinking at a block 486. A decision blocked 488 determines whether an employee has swiped their card at the help module 16 or the CAU 12. If not, then the program loops back. Once the card is swiped, then the swipe card message is sent via the CAU 12 to the cloud server 18 at a block 490 and the LED 78 is turned off at a block 492.

FIG. 13B illustrates the routine implemented in the cloud server 18. When a message is received it is placed in a queue at a block 494. The message is parsed at a block 496. If the message is a help message, at a block 498, then a timer and count operation is started at a block 500. If the message is a swipe card message, at a block 502, then the server 18 stops the timing and count operation at a block 504 and saves the information at a block 506.

Thus, as described, the wireless security and assistance system 10 comprises the CAU 12 including a programmed controller and a CAU UWB wireless communication circuit. Each wireless LPS sensor 14 comprises an integrated programmed controller and sensor wireless communication circuit. The LPS sensor 14 communicates with the CAU 12. A tamper detection circuit 68 is associated with a push button or tether, or the like, to maintain the sensor 14 in an operative state on a portable article being monitored. The LPS sensor 14 generates an alert signal in the event that the securing assembly is altered with the sensor 14 in an operative state in a manner that allows separation of the sensor 14 from the portable article being monitored. The CAU 12 is programmed to periodically determine distance between the LPS sensor 14 and the CAU 12. The CAU selectively operates in a programming mode and is responsive to manual input commands from the sensor to define a normal distance of the article being monitored from the CAU 12 and to define a first zone as the normal distance plus a first select amount and a second zone as the normal distance plus a second select amount, greater than the first select amount. In an arm mode if the CAU 12 determines that the LPS sensor 14 is in the second zone then the CAU 12 causes the LPS sensor 14 to generate a warning alert signal and if the CAU 12 determines that the LPS sensor 14 is outside the second zone then the CAU 12 causes the LPS sensor 14 to generate an alarm alert signal.

The present invention may be a system, a method, and/or a computer program product. The computer program product may include a computer readable storage medium (or media) having computer readable program instructions thereon for causing a processor to carry out aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The foregoing disclosure of specific embodiments is intended to be illustrative of the broad concepts comprehended by the invention.

The invention claimed is:

1. A wireless assistance system for monitoring portable articles comprising:

a central alarm unit (CAU) comprising a programmed controller operatively associated with a CAU wireless communication circuit and a CAU alarm device; and at least one wireless sensor comprising a programmed controller operatively associated with a sensor wireless communication circuit, for communicating with the CAU wireless communication circuit, a tamper detection circuit configured to determine if the wireless sensor is in an operative state on a portable article being monitored, an alert signal device to generate an alert signal in the event that the tamper detection circuit determines that the wireless sensor is not in the operative state, and a user input device for receiving manual input commands, wherein the CAU is programmed to periodically determine distance between the wireless sensor and the CAU, and the CAU selectively operating in a programming mode and responsive to manual input commands to determine a normal distance of the article being monitored from the CAU and to define a first zone as the normal distance plus a first select amount and a second zone as the normal distance plus a second select amount, greater then the first select amount, and in an arm mode if the CAU determines that the wireless sensor is in the second zone then causing the wireless sensor to generate a warning alert signal and if the CAU determines that the wireless sensor is outside the second zone then causing the wireless sensor to generate an alarm alert signal.

2. The wireless assistance system according to claim 1 wherein the tamper detection circuit comprises a tether that in conjunction with the wireless sensor extends fully around a part of a portable article being monitored with the wireless sensor in its operative state.

3. The wireless assistance system according to claim 1 wherein the tamper detection circuit comprises a tether that extends fully around a part of an article being monitored with the wireless sensor in its operative state.

4. The wireless assistance system according to claim 1 wherein the tamper detection circuit comprises a tether that defines at least a part of an electrical circuit path, and the securing circuit is configured to generate the alert signal in the event that the electrical circuit path is interrupted.

5. The wireless assistance system according to claim 1 wherein the CAU generates an alarm alert signal if the wireless sensor is outside the second zone.

6. The wireless assistance system according to claim 1 wherein the CAU generates an alert signal if communication is lost with the at least one wireless sensor.

7. The wireless assistance system according to claim 5 wherein the CAU is programmed to generate the alarm alert signal until the CAU is switched to a disarm mode.

8. The wireless assistance system according to claim 1 further comprising a server in communication with the CAU unit and wherein the CAU periodically transmits messages to the server on status of the wireless sensor.

9. The wireless assistance system according to claim 8 wherein the wireless sensor comprises a motion detector and the wireless sensor sends signals to the CAU responsive to movement of the portable article being monitored and the server stores data on movement of the portable article being monitored.

10. The wireless assistance system according to claim 8 wherein the CAU is programmed, responsive to receipt of a manual input command from the wireless sensor in an arm mode, to communicate with the server to send a message requesting assistance at the wireless sensor.

11. The wireless assistance system according to claim 1 further comprising a help module comprising a programmed controller operatively associated with a help module wireless communication circuit, for communicating with the CAU wireless communication circuit and comprising a call button and the system is programmed to send a message requesting assistance at the help module responsive to activation of the call button.

12. A wireless assistance system for monitoring portable articles comprising:

a central alarm unit (CAU) comprising a programmed controller operatively associated with a CAU wireless communication circuit and a CAU alarm device; and a plurality of wireless sensors each comprising a programmed controller operatively associated with a sensor wireless communication circuit, for communicating with the CAU wireless communication circuit, a tamper detection circuit configured to determine if the wireless sensor is in an operative state on a portable article being monitored, an alert signal device to generate an alert signal in the event that the tamper detection circuit determines that the wireless sensor is not in the operative state, and a user input device for receiving manual input commands, wherein the CAU is programmed to periodically determine distance between each wireless sensor and the CAU, and the CAU selectively operates in a programming mode and responsive to manual input commands to determine a normal distance of the article being monitored from the CAU and to define a first zone as the normal distance plus a first select amount and a second zone as the normal distance plus a second select amount, greater then the first select amount, and in an arm mode if the CAU determines that a select wireless sensor is in the first zone then causing the select wireless sensor to generate a warning alert signal and if the CAU determines that the select wireless sensor is in the second zone then causing the select wireless sensor to generate an alarm alert signal.

13. The wireless assistance system according to claim 12 wherein the tamper detection circuit comprises a tether that in conjunction with the wireless sensor extends fully around a part of a portable article being monitored with the wireless sensor in its operative state.

14. The wireless assistance system according to claim 12 wherein the tamper detection circuit comprises a tether that extends fully around a part of an article being monitored with the wireless sensor in its operative state.

15. The wireless assistance system according to claim 12 wherein the tamper detection circuit comprises a tether that defines at least a part of an electrical circuit path, and the tamper detection circuit is configured to generate the alert signal in the event that the electrical circuit path is interrupted.

16. The wireless assistance system according to claim 12 wherein the CAU generates an alarm alert signal if any of the plurality of wireless sensors are outside the second zone.

17. The wireless assistance system according to claim 12 wherein the CAU generates an alert signal if communication is lost with any of the plurality of wireless sensors.

18. The wireless assistance system according to claim 16 wherein the CAU is programmed to generate the alarm alert signal until the CAU is switched to a disarm mode.

19. The wireless assistance system according to claim 12 further comprising a server in communication with the CAU unit and wherein the CAU periodically transmits messages to the server on status of the wireless sensors.

20. The wireless assistance system according to claim 12 wherein each wireless sensor comprises a motion detector and the wireless sensors send signals to the CAU responsive to movement of the portable articles being monitored and the server stores data on movement of the portable articles being monitored.

21. The wireless assistance system according to claim 12 wherein the CAU is programmed, responsive to receipt of a manual input command form a wireless sensor in an arm mode, to communicate with the server to send a message requesting assistance at the wireless sensor.

22. The wireless assistance system according to claim 12 further comprising a help module comprising a programmed controller operatively associated with a help module wireless communication circuit, for communicating with the CAU wireless communication circuit and comprising a call button and the system is programmed to send a message requesting assistance at the help module responsive to activation of the call button.

23. The wireless assistance system according to claim 22 wherein the server sends an SMS message to request assistance at the help module.

24. The wireless assistance system according to claim 22 wherein the help module comprises an indicator that is activated responsive to activation of the call button and the indicator is cancelled responsive to assistance being provided at the help module.

25. The wireless assistance system according to claim 24 wherein the help module comprises a card reader activated responsive to a user ID card and the indicator is cancelled responsive activation of the card reader.

26. The wireless assistance system according to claim 12 wherein the normal distance is determined responsive to a number of times that a manual input command is received from the wireless sensor in the programming mode.

27. The wireless assistance system according to claim 21 wherein the server stores data about length of time for a response to a request for assistance from one of the wireless sensors.

28. The wireless assistance system according to claim 22 wherein the server stores data about length of time for a response to a request for assistance from the help module.

* * * * *